US009115878B2

(12) United States Patent
Ancona et al.

(10) Patent No.: US 9,115,878 B2
(45) Date of Patent: Aug. 25, 2015

(54) SPOTLIGHT WITH CLAMP

(71) Applicant: BLACKBEAM LLC, New York, NY (US)

(72) Inventors: Bruce Ancona, New York, NY (US); Louis F. Henry, Scarsdale, NY (US); Chris Mellen, New York, NY (US)

(73) Assignee: Blackbeam LLC, New York, NY (US)

( * ) Notice: Subject to any disclaimer, the term of this patent is extended or adjusted under 35 U.S.C. 154(b) by 0 days.

(21) Appl. No.: 14/075,962

(22) Filed: Nov. 8, 2013

(65) Prior Publication Data

US 2014/0126191 A1 May 8, 2014

Related U.S. Application Data

(60) Provisional application No. 61/724,243, filed on Nov. 8, 2012.

(51) Int. Cl.

| | |
|---|---|
| ***F21V 21/08*** | (2006.01) |
| ***F21V 21/088*** | (2006.01) |
| ***F21L 4/00*** | (2006.01) |
| ***F21L 4/04*** | (2006.01) |

(52) U.S. Cl.

CPC ..... *F21V 21/0885* (2013.01); *F21L 4/00* (2013.01); *F21L 4/04* (2013.01)

(58) Field of Classification Search

USPC ..... 362/396, 191, 202

See application file for complete search history.

(56) References Cited

U.S. PATENT DOCUMENTS

| | | | | |
|---|---|---|---|---|
| 1,360,531 | A | 11/1920 | Hyatt | |
| 1,483,588 | A | 2/1924 | Simmons et al. | |
| 1,606,219 | A | 11/1926 | Havens | |
| 1,954,756 | A | 4/1934 | Kidston et al. | |
| 2,034,913 | A | 3/1936 | Kros | |
| 4,376,965 | A | 3/1983 | Bacevius | |
| 4,399,498 | A | 8/1983 | Bacevius | |
| 4,533,982 | A | 8/1985 | Kozar | |
| 4,654,764 | A | 3/1987 | Hsiao | |
| D324,110 | S | 2/1992 | Yuen | |
| 5,101,333 | A * | 3/1992 | Glassford | 362/413 |
| 5,420,767 | A | 5/1995 | Jones | |
| 5,448,463 | A | 9/1995 | Leen | |

(Continued)

FOREIGN PATENT DOCUMENTS

| | | |
|---|---|---|
| CN | 2415242 Y | 1/2001 |
| CN | 2546726 Y | 4/2003 |

(Continued)

OTHER PUBLICATIONS

International Search Report dated Aug. 23, 2013 from corresponding International Application No. PCT/US2013/038856, 3 pages.

(Continued)

*Primary Examiner* — Ali Alavi

(74) *Attorney, Agent, or Firm* — Ohlandt, Greeley, Ruggiero & Perle, L.L.P.

(57) ABSTRACT

The present disclosure provides a spotlight having a clamp that can be affixed to objects. Advantageously, the spotlight can be used portably, or affixed to an object for hands-free use. The head of the spotlight can pivot, and also rotate fully, to provide a variety of lighting angles. The body of the spotlight can include a battery compartment that is sealed to satisfy applicable waterproofing standards.

16 Claims, 4 Drawing Sheets

(56) References Cited

U.S. PATENT DOCUMENTS

| | | | | |
|---|---|---|---|---|
| D376,865 | S | 12/1996 | Chan | |
| D378,434 | S | 3/1997 | Petterson et al. | |
| D404,839 | S | 1/1999 | Petterson et al. | |
| 5,871,272 | A | 2/1999 | Sharrah et al. | |
| D410,557 | S | 6/1999 | Petterson et al. | |
| 5,993,022 | A | 11/1999 | Neyer et al. | |
| 6,012,827 | A | 1/2000 | Caplan et al. | |
| 6,062,703 | A | 5/2000 | Tsao | |
| D428,175 | S | 7/2000 | Lynch et al. | |
| 6,176,592 | B1 | 1/2001 | Kovacik et al. | |
| 6,428,192 | B1 | 8/2002 | Chen | |
| 6,457,841 | B1 | 10/2002 | Lynch et al. | |
| D467,375 | S | 12/2002 | Dalton et al. | |
| 6,575,587 | B2 | 6/2003 | Cramer et al. | |
| 6,585,400 | B2 | 7/2003 | Leen | |
| 6,764,194 | B1 | 7/2004 | Cooper | |
| D496,483 | S | 9/2004 | Christianson | |
| 6,802,623 | B1 | 10/2004 | Hsu et al. | |
| 6,905,223 | B2 | 6/2005 | Halasz | |
| 6,913,370 | B2 | 7/2005 | Ping | |
| 7,011,423 | B2 | 3/2006 | Chen | |
| 7,040,783 | B1 | 5/2006 | Christianson | |
| 7,063,435 | B2 | 6/2006 | Dallas et al. | |
| 7,111,965 | B2 | 9/2006 | Hsu | |
| 7,172,310 | B2 | 2/2007 | Hsu | |
| 7,175,318 | B2 | 2/2007 | Booty, Jr. | |
| D541,965 | S | 5/2007 | Shiu | |
| D542,450 | S | 5/2007 | Shiu | |
| 7,222,996 | B2 | 5/2007 | Lin | |
| D554,783 | S | 11/2007 | Shiu | |
| 7,318,657 | B2 | 1/2008 | Booty, Jr. | |
| 7,347,582 | B1 | 3/2008 | Kung | |
| 7,347,596 | B2 | 3/2008 | Ishikawa | |
| 7,357,540 | B2 | 4/2008 | Booty, Jr. | |
| 7,390,105 | B2 | 6/2008 | Nelson et al. | |
| 7,410,272 | B2 | 8/2008 | Halasz | |
| 7,481,554 | B2 | 1/2009 | Anderson et al. | |
| 7,513,662 | B2 | 4/2009 | Parker et al. | |
| 7,540,623 | B2 | 6/2009 | Petzl et al. | |
| 7,572,024 | B2 | 8/2009 | Ko et al. | |
| D605,795 | S | 12/2009 | Baker et al. | |
| D612,967 | S | 3/2010 | Gan et al. | |
| 7,703,952 | B2 | 4/2010 | Yoon | |
| 7,850,329 | B2 | 12/2010 | Henry et al. | |
| 8,025,420 | B2 | 9/2011 | Henry et al. | |
| 8,262,246 | B2 | 9/2012 | Pelletier et al. | |
| 8,348,454 | B2 | 1/2013 | Henry et al. | |
| 8,506,111 | B2 | 8/2013 | Woods | |
| 2003/0067771 | A1 | 4/2003 | Kung | |
| 2008/0055888 | A1 | 3/2008 | Sharrah et al. | |
| 2009/0122562 | A1 | 5/2009 | Lee | |
| 2009/0154161 | A1 | 6/2009 | Parker et al. | |
| 2009/0279290 | A1* | 11/2009 | Henry et al. | 362/191 |
| 2010/0091483 | A1 | 4/2010 | Henry et al. | |
| 2011/0222274 | A1* | 9/2011 | Ko et al. | 362/191 |

FOREIGN PATENT DOCUMENTS

| | | | |
|---|---|---|---|
| CN | 1645417 | A | 7/2005 |
| DE | 603452 | C | 5/1936 |
| DE | 1693610 | U | 2/1955 |
| DE | 1699202 | U | 5/1955 |
| DE | 1630446 | A1 | 10/1971 |
| DE | 202005017359 | U1 | 3/2006 |
| EP | 0156290 | A2 | 10/1985 |
| EP | 0156434 | A2 | 10/1985 |
| EP | 1541918 | A2 | 6/2005 |
| EP | 2281141 | B1 | 5/2012 |
| JP | 6267401 | A | 4/1987 |
| JP | 2002367401 | A | 12/2002 |
| JP | 2005071884 | A | 3/2005 |
| JP | 2006185755 | A | 7/2006 |
| JP | 2007005201 | A | 1/2007 |

OTHER PUBLICATIONS

Written Opinion dated Aug. 23, 2013 from corresponding International Application No. PCT/US2013/038856, 7 pages.
Blackfire. Blackfire Clamplight. Blackfire. Feb. 8, 2011. [Retrieved on: Aug. 14, 2013]. 2 pages.
English Translation of First Office Action dated Jul. 12, 2010 from corresponding Chinese Application No. 200810215919.7, 4 pages.
European Search Report dated Apr. 26, 2011 from corresponding EP 09743456.7, 7 pages.
International Search Report from corresponding PCT/US2009/042830 dated Jul. 7, 2009, 3 pages.
Written Opinion dated Jul. 7, 2009 from corresponding PCT/US2009/042830, 4 pages.
International Preliminary Report on Patentability from corresponding PCT/US2009/042830 dated Jul. 20, 2010, 7 pages.
English Translation of Second Office Action dated Jan. 10, 2011 from corresponding Chinese Application No. 200810215919.7, 5 pages.
English Translation of Third Office Action dated May 12, 2011 from corresponding Chinese Application No. 200810215919.7, 5 pages.
English Translation of Decision of Rejection dated Jan. 6, 2012 from corresponding Chinese Application No. 200810215919.7, 10 pages.
English Translation of Notice of Reexamination dated Jul. 2, 2013 from corresponding Chinese Application No. 200810215919.7, 5 pages.
English Translation of Examination Decision dated Jan. 29, 2014 from corresponding Chinese Application No. 200810215919.7, 11 pages.
Office Action dated Jul. 25, 2011 from corresponding Canadian Application No. 2691533, 3 pages.
European Search Report dated Feb. 14, 2013 from corresponding EP 12194419, 2 pages.
English translation of Preliminary Office Action dated Nov. 15, 2011 from corresponding Israeli Application No. 209138, 7 pages.
English translation of First Office Action dated May 10, 2012 from corresponding Israeli Application No. 209138, 3 pages.
Second Office Action (with English translation) dated Feb. 16, 2014 from corresponding Israeli Application No. 209138, 9 pages.
English translation of First Office Action dated Apr. 23, 2013 from corresponding Japanese Application No. 2011-508601, 6 pages.
English translation of Second Office Action dated Dec. 10, 2013 from corresponding Japanese Application No. 2011-508601,8 pages.
English translation of First Office Action dated Dec. 4, 2010 from corresponding Mexican Application No. MX/a/2010/012157, 2 pages.
English translation of Second Office Action dated Dec. 7, 2011 from corresponding Mexican Application No. MX/a/2010/012157, 2 pages.
First Office Action (with English translation) dated Jan. 23, 2013 from corresponding Russian Application No. 2010149093,6 pages.
Office Action dated Sep. 6, 2012 from corresponding U.S. Appl. No. 29/400,932, 12 pages.
Office Action dated Jan. 8, 2013 from corresponding U.S. Appl. No. 29/400,932, 5 pages.
Office Action dated Sep. 12, 2013 from corresponding U.S. Appl. No. 13/544,521, 14 pages.
Office Action dated Mar. 21, 2014 from corresponding U.S. Appl. No. 13/544,521, 8 pages.
Office Action dated Mar. 4, 2014 from corresponding U.S. Appl. No. 13/873,957, 21 pages.
European Patent Office letter dated Apr. 11, 2012 from corresponding EP 09743456.7, 2 pages.
European Patent Office letter dated May 10, 2012 from corresponding EP 09743456.7, 3 pages.
Office Action dated Jun. 21, 2011 from corresponding U.S. Appl. No. 13/322,214, 8 pages.
Office Action dated Dec. 1, 2011 from corresponding U.S. Appl. No. 13/322,214, 9 pages.
Office Action dated May 30, 2012 from corresponding U.S. Appl. No. 13/322,214, 10 pages.
Office Action dated Oct. 1, 2010 from corresponding U.S. Appl. No. 13/638,312, 7 pages.

(56) References Cited

OTHER PUBLICATIONS

Office Action dated Mar. 22, 2011 from corresponding U.S. Appl. No. 13/638,312, 8 pages.
European Patent Office Notice of Opposition dated Sep. 10, 2013 from corresponding EP 09743456.7, 16 pages.
Amazon.de, "Varta 642 Clamplight Taschenlampe" cited Jun. 10, 2003, 2 pages.
International Search Report dated Apr. 4, 2014 from corresponding International Application No. PCT/US2013/069297, 3 pages.
Written Opinion dated Apr. 4, 2014 from corresponding International Application No. PCT/US2013/069297, 6 pages.

* cited by examiner

SPOTLIGHT WITH CLAMP

CROSS-REFERENCE TO RELATED APPLICATION

The present application claims priority to U.S. Provisional Patent Application No. 61/724,243, filed on Nov. 8, 2012, which is incorporated herein by reference.

BACKGROUND OF THE DISCLOSURE

1. Field of the Disclosure

The present disclosure relates to a flashlight. More particularly, the present disclosure relates to a portable spotlight that has a clamp for mounting to various surfaces, and a swivel head with full rotation.

2. Description of the Related Art

There is a significant need among users of flashlights and/or spotlights to have some sort of "hands-free" capability and flexibility in mounting options. This is so the user can have both hands available to work on a task while the spotlight illuminates a target or work space, or to take advantage of different kinds of mounting surfaces. Currently available spotlights do not present the user with a variety of ways to hold the light or affix and detach it from a mounting surface.

Accordingly, there is a need for a lantern that can provide hands-free operation for a user, while simultaneously providing a portable capability.

SUMMARY OF THE DISCLOSURE

The present disclosure provides a spotlight, comprising: a head, wherein the head comprises a light source; a body, wherein the head is connected to the body at a first end of the body; a handle comprising a grip and a lever; and a clamp comprising a first clamp arm and a second clamp arm. The lever of the handle is connected to at least one of the first clamp arm and the second clamp arm, so that actuation of the lever causes the clamp to open.

BRIEF DESCRIPTION OF THE DRAWINGS

FIG. 2 shows a second perspective view of the spotlight of FIG. 1;

DETAILED DESCRIPTION OF THE DISCLOSURE

Figure 1:
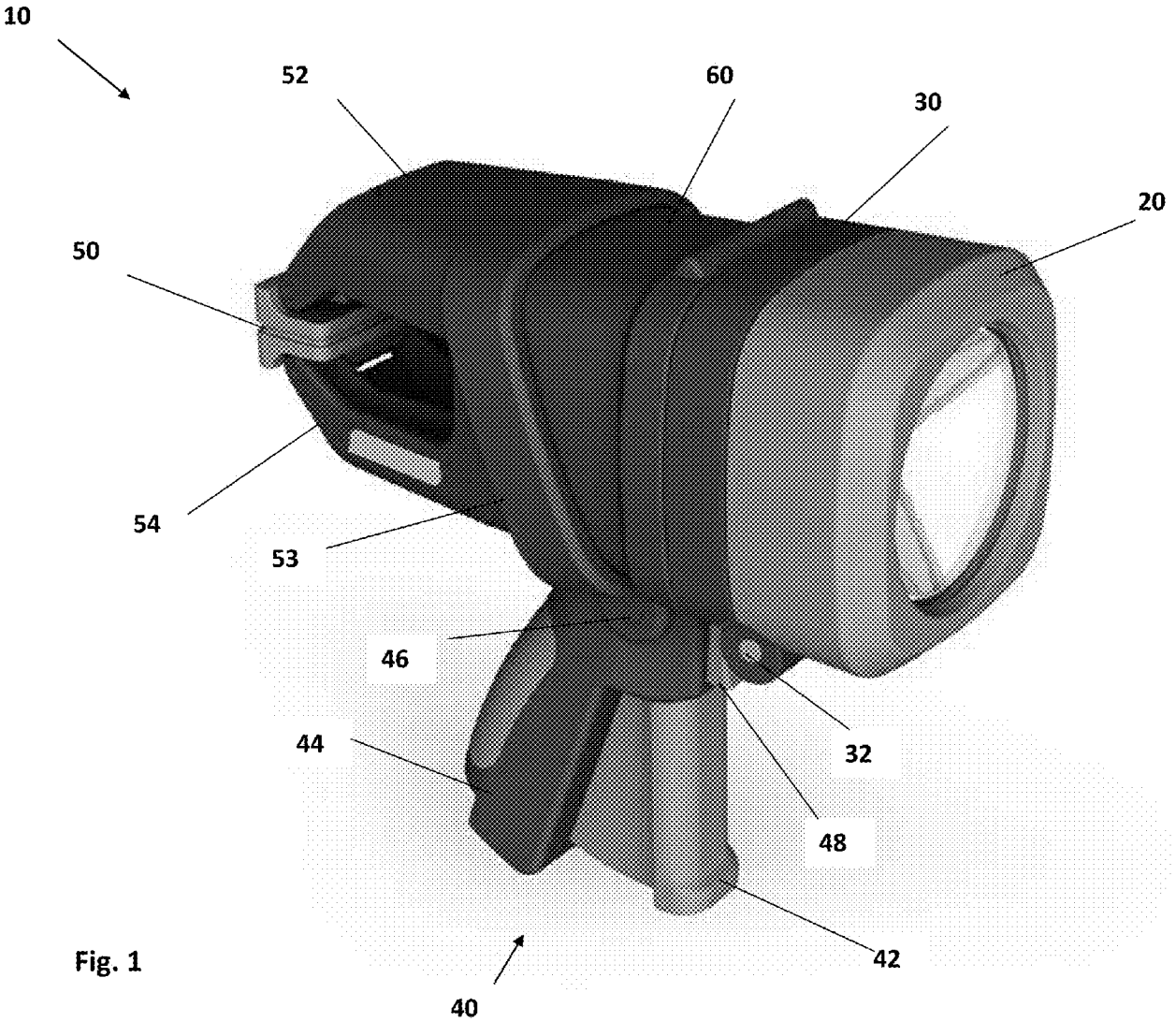
FIG. 1 shows a first, perspective view of the spotlight of the present disclosure.
Figure 3:
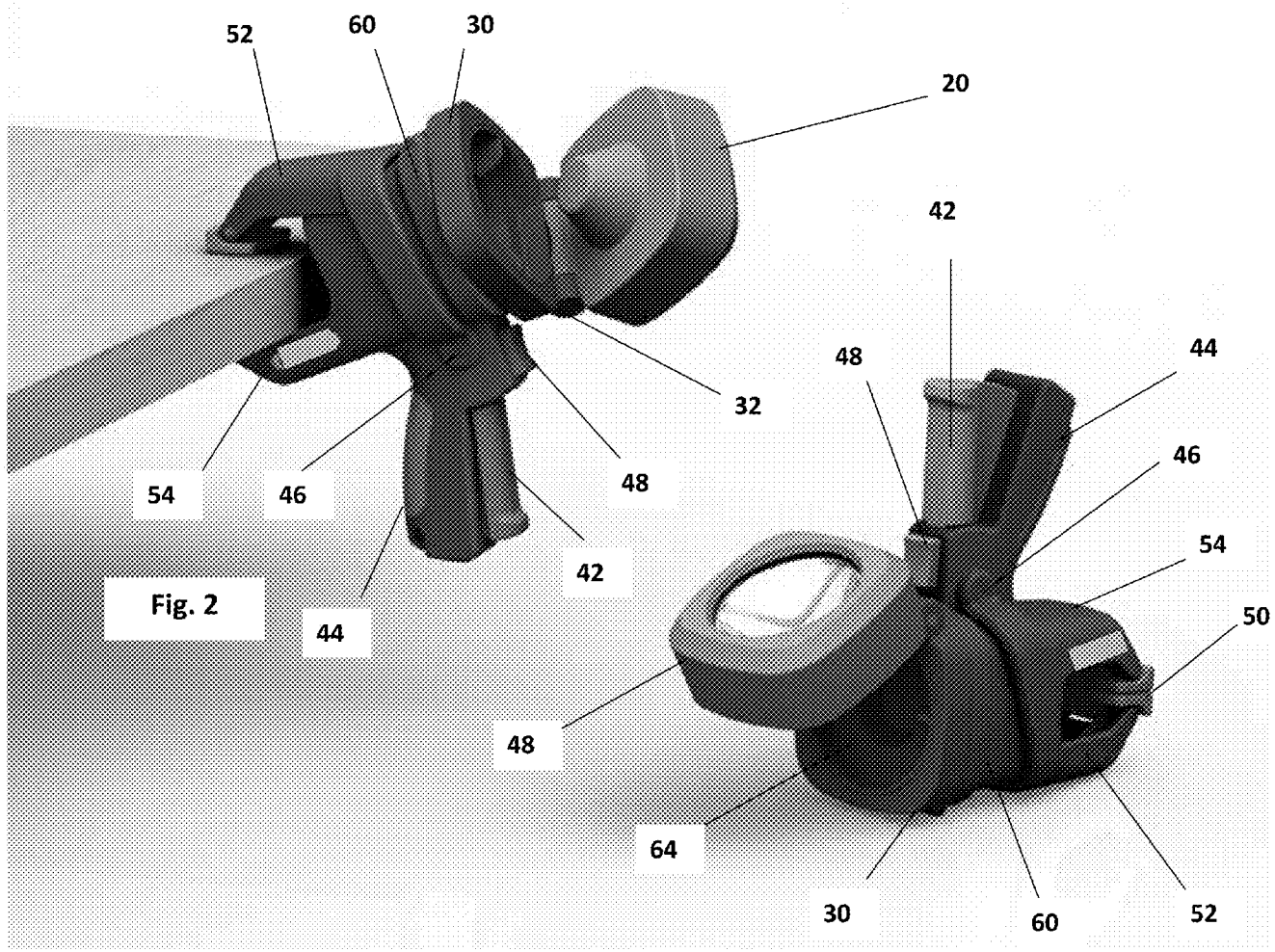
FIG. 3 shows a third perspective view of the spotlight of FIG. 1.

Referring to FIGS. 1-5, spotlight 10 is shown. Spotlight 10 has head 20, mount 30, handle 40, clamp 50, and body 60. A user can hold spotlight 10 with handle 40, in a portable use mode. When clamp 50 is in the closed position, as shown in FIG. 1, handle 40 can be easily and comfortably gripped by the user. The user can also squeeze handle 40, in the manner discussed in greater detail below, to open up clamp 50, which can be affixed to an object. Head 20 pivots with respect to mount 30, and mount 30 rotates about a longitudinal axis of body 60. This offers the ability to move head 20 in to a variety of positions (some of which are shown in FIGS. 2 and 3) to better illuminate a particular space. Thus, spotlight 10 offers a user a variety of ways to hold and use it, which are not available in current devices.

For ease of describing spotlight 10, the words "front," "back," "top," and "bottom" reference the depiction shown in FIG. 1, where light points out of the front of head 20, clamp 50 is located at the back of spotlight 10, and handle 40 is on the bottom of spotlight 10.

Handle 40 has grip 44 and lever 42. Clamp 50 has upper arm 52 and lower arm 54. Lever 42 is connected to upper arm 52 so that when the user squeezes grip 44 and lever 42, upper arm 52 rotates about pivot 46 to open clamp 50. This can be a particularly advantageous when, for example, spotlight 10 is used in outdoor applications and a user may have gloves on that limit hand mobility. Opening clamp 50 by squeezing trigger-like grip 44 and lever 42 makes it easier for such a user to do so.

For ease of assembly, lever 42 and upper arm 52 are separate pieces, but can be permanently connected to one another when assembled in spotlight 10. Upper arm 52 can have one or more side braces 53 that surround body 60, and connect at pivot 46. Body 60 can be integrally formed (e.g., molded as one piece) with lower arm 54.

Head 20 is connected to mount 30 at pivot 32. As shown in FIGS. 2 and 3, this enables head 20 to be placed in any desired position along the arc of rotation. Mount 30 is connected to body 60 in such a way that it can rotate about a longitudinal axis of body 60. This allows for even more flexibility in positions for head 20. Unlike in many other flashlight or spotlight devices, head 20 can rotate a full three-hundred sixty degrees around the longitudinal axis of body 60, meaning that head 20 can be placed in many positions not available with current devices.

Head 20 has a light source (not shown) therein, to project light out of the face of head 20. The light source can be one or more light-emitting diodes (LEDs). The light source can also have a power of two-hundred-fifty (250) lumens or more. In spotlight 10, reflectors within head 20 (not shown) can be employed to shine emitted light at significant distances, as opposed to the medium-range reflectors of smaller flashlights. As shown in the Figures, spotlight 10 needs a bigger casing and requires more battery power than smaller flashlights to achieve this effect. In one embodiment, spotlight 10 can require four C-size or D-size batteries for power.

Figure 4:
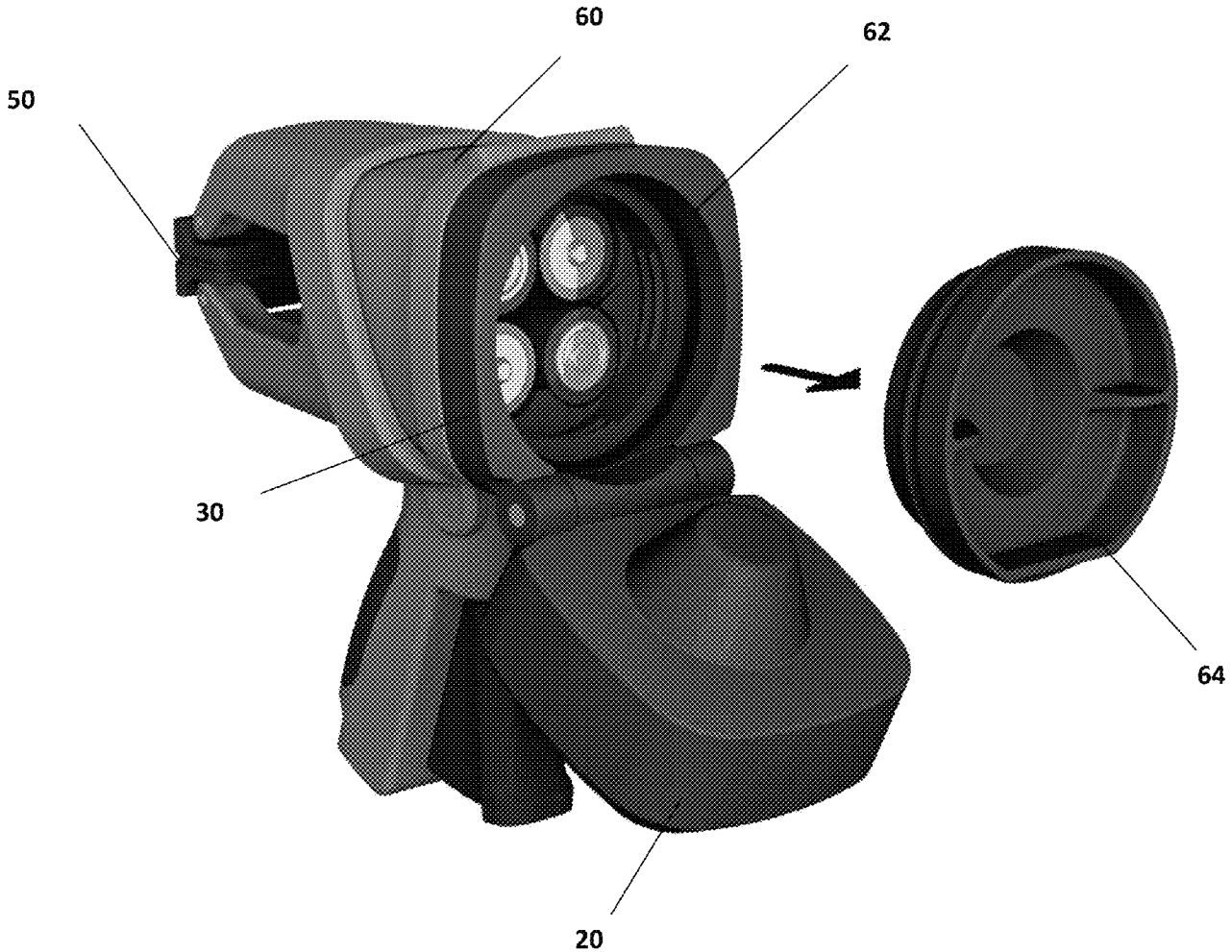
FIG. 4 shows a perspective view of the spotlight of FIG. 1, with the battery compartment opened.
Figure 5:
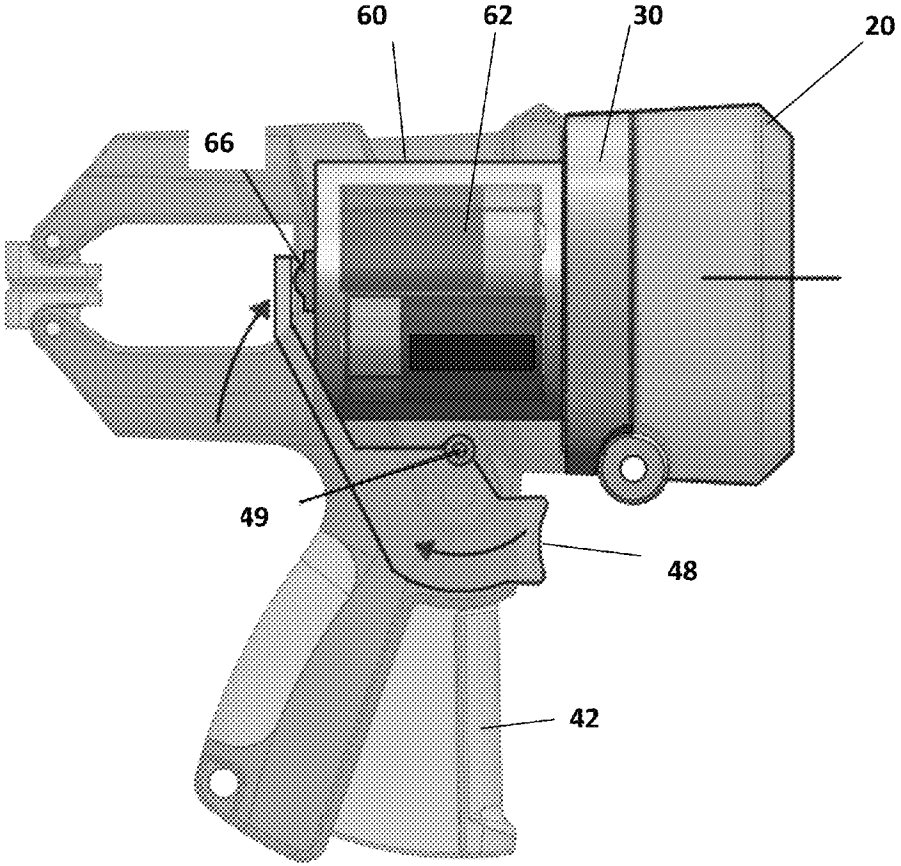
FIG. 5 shows a side, transparent view of the spotlight of FIG. 1.

As shown in FIG. 4, body 60 has a battery compartment 62 therein. Cover 64 can be connected to compartment 62 (such as with a friction, snap-, or screw-fit) to secure the batteries within compartment 62. The batteries within compartment 62 are in electrical communication with the light source to provide power thereto. Advantageously, the batteries in compartment 62 are selectively placed in electrical communication with the light source with trigger 48 on handle 40. Trigger 48 pivots about second pivot 49, and activates a switch 66 in the rear of compartment 62. In one embodiment, the batteries within compartment 62 can be placed in electrical communication with the light source through contacts in or lead wires strung through pivot 32. Trigger 48 is also advantageous in that it is ergonomically designed to be easily gripped while the user is holding handle 40.

In the shown embodiment of spotlight 10, mount 30 is permanently connected to compartment 62, or molded together as one piece. Compartment 62 thus rotates with mount 30 within body 60. The location of switch 66 at the rear of compartment 62 allows for the full, three-hundred-sixty-degree rotation of mount 30, and thus head 20. In many currently available spotlights, the switch activating the light source may be close to the head, and/or would require wiring therebetween that would restrict the rotational motion of the mount. Spotlight 10 does not have this disadvantage.

Cover 64 can be sealingly connected to battery compartment 62, so that spotlight 10 can satisfy waterproofing standards (e.g., IPX4 or IPX7). A membrane (not shown) can also be placed over switch 66 to further provide waterproofing ability.

In another embodiment, mount 30 is a separate component than compartment 62 and is movably connected thereto, so that mount 30 rotates while compartment 62 stays fixed within body 60. In this embodiment, a power switch (not shown) selectively placing the batteries in electrical communication with the light source could be closer to the head, at the front of body 60. One or more electrical contacts (not shown) could be placed in or around body 60 and mount 30, so that mount 30 maintains electrical communication throughout its full rotation. This method may also be achieved in the embodiment described above, where mount 30 and compartment 62 are one integral piece or permanently attached. Electrical contacts could be in compartment 62 and a switch in body 60, again maintaining communication throughout full rotation.

In another embodiment of spotlight 10, head 20 and mount 30 are fixed, and do not rotate or pivot. This embodiment would be less costly to manufacture, would allow for easier compliance with waterproofing standards, and still provide the features of handle 40 and clamp 50 described above.

In clamp 50, upper arm 52 and lower arm 54 are biased into a closed position. A spring, actuator, or other device (not shown) can be placed between upper arm 52 and lower arm 54, to create tension therebetween and effect the bias. Upper arm 52, lower arm 54, and the spring device can be connected to each other with a pivot pin that travels through corresponding holes in upper arm 52, lower arm 54, the spring device, and spacers or covers that can be used to stabilize the spring device.

In one embodiment, the spring device is a torsion spring. The present disclosure, however, contemplates any devices that can create tension between upper arm 52 and lower arm 54, such as tension springs, extension springs, compression springs, integral plastic springs, wire or coil springs, and flat springs.

Any of the above described components can be made of materials such as acrylonitrile butadiene styrene (ABS), nylon, or other plastics, or can be made of cast or stamped metal.

Again, spotlight 10 provides uses and applications very different than current spotlights or flashlights. Spotlights can be used to project light at great distance. Having the ability to affix the spotlight 10 and have it operate independently of the user is of great importance. For example, when fishing, a spotlight can be used to see across expanses of water. During that time the user may be driving the boat, fishing, or otherwise occupied so his hands cannot be used to hold the light. Many flashlights, by contrast, are more suitable for close-in immediate work. Another application is in hunting. Hunters may want a light to be on a prey while operating a gun, which requires both hands. Alternatively, a light may need to be affixed in one area, shining on a desired location, while the hunter is in another location. Another application that a flashlight may not be equipped for is on vehicles. Spotlights can be used to illuminate areas that headlights are not reaching, for example the side of the vehicle. Using spotlight 10, which can be mounted to the vehicle, allows the driver to drive. Spotlights are often used for long periods of time, so holding them would not be practical. Mounting a spotlight such as spotlight 10 on the front of a boat, for example, and leaving it there for two hours would not be an uncommon use, where most flashlight uses are shorter term. Spotlight 10—is particularly well-suited for all of these applications and more.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated for carrying out this disclosure.

What is claimed is:

1. A spotlight, comprising:

a head, wherein said head comprises a light source therein;

a body, wherein said head is connected to said body at a first end of said body;

a handle comprising a grip and a lever; and a clamp comprising a first clamp arm and a second clamp arm, wherein said first clamp arm integrally formed with said body, wherein said clamp is located at a second end of said body opposite to said first end, and wherein said lever of said handle is connected to said second clamp arm, so that actuation of said lever causes said second clamp arm to pivot about a pivot point to open said clamp.

2. The spotlight of claim 1, further comprising a battery compartment in said body, wherein said battery compartment is in electrical communication with said light source.

3. The spotlight of claim 2, further comprising a trigger, wherein said trigger selectively places said battery compartment in electrical communication with said light source.

4. The spotlight of claim 3, wherein said trigger actuates a switch on said battery compartment to selectively place said battery compartment in electrical communication with said light source.

5. The spotlight of claim 2, further comprising a power source within said battery compartment, wherein said power source provides power to said light source to that an output of said light source is two-hundred-fifty lumens or greater.

6. The spotlight of claim 1, wherein said head is connected to said body with a mount, wherein said head pivots with respect to said mount, and said mount rotates about a longitudinal axis of said body.

7. The spotlight of claim 1, wherein said mount rotates three-hundred-sixty degrees about said longitudinal axis of said body.

8. The spotlight of claim 1, wherein said clamp is biased in a closed position.

9. A spotlight, comprising:

a head, wherein said head comprises a light source;

a body, wherein said head is connected to said body at a first end of said body via a mount, wherein said head pivots with respect to said mount, and said mount rotates about a longitudinal axis of said body;

a handle comprising a grip and a lever; and a clamp comprising a first clamp arm and a second clamp arm, wherein said lever of said handle is connected to at least one of said first clamp arm and said second clamp arm, so that actuation of said lever causes said clamp to open.

10. The spotlight of claim 9, wherein said clamp is biased in a closed position.

11. The spotlight of claim 9, wherein said clamp is connected to said body at a second end of said body opposite to said first end, wherein said first clamp arm is integrally formed with said body, and wherein said second clamp arm is connected to said lever, so that said second clamp arm pivots about a pivot point to open said clamp.

12. The spotlight of claim 9, further comprising a battery compartment in said body, wherein said battery compartment is in electrical communication with said light source.

13. The spotlight of claim 12, further comprising a trigger, wherein said trigger selectively places said battery compartment in electrical communication with said light source.

14. The spotlight of claim 13, wherein said trigger actuates a switch on said battery compartment to selectively place said battery compartment in electrical communication with said light source.

15. The spotlight of claim 12, further comprising a power source within said battery compartment, wherein said power source provides power to said light source to that an output of said light source is two-hundred-fifty lumens or greater.

16. The spotlight of claim 9, wherein said mount rotates three-hundred-sixty degrees about said longitudinal axis of said body.

* * * * *